United States Patent [19]

Ichimura et al.

[11] Patent Number: 5,032,483

[45] Date of Patent: Jul. 16, 1991

[54] ELECTROPHOTOGRAPHIC RED TONER

[75] Inventors: Masanori Ichimura; Toru Murakami; Koichi Oyamada, all of Kanagawa, Japan

[73] Assignee: Fuji Xerox Co., Ltd., Tokyo, Japan

[21] Appl. No.: 438,991

[22] Filed: Nov. 22, 1989

Related U.S. Application Data

[63] Continuation of Ser. No. 138,799, Dec. 29, 1987, abandoned.

[30] Foreign Application Priority Data

Jan. 13, 1987 [JP] Japan ..... 62-004104

[51] Int. Cl.[5] ..... G03G 9/09

[52] U.S. Cl. ..... 430/106

[58] Field of Search ..... 430/106, 106.6

[56] References Cited

U.S. PATENT DOCUMENTS 4,530,893 7/1985 Maekawa et al. ..... 430/106.6

4,758,489 7/1988 Tomita et al. ..... 430/106

*Primary Examiner*—John Goodrow

*Attorney, Agent, or Firm*—Finnegan, Henderson, Farabow, Garrett, and Dunner

[57] ABSTRACT

A red color toner for electrophotography comprising a binder resin and a colorant component comprising C.I. Pigment Red 48:1, or C.I. Pigment Red 48:1 and a second red pigment which may be C.I. Pigment Red 122 or C.I. Pigment Red 57:1, or C.I. Pigment Red 48:1 and a yellow pigment which may be C.I. Pigment Yellow 97 or C.I. Pigment Yellow 12. The colorant preferably is present in an amount between about 1% and about 20% by weight of the binder resin.

5 Claims, 2 Drawing Sheets

ELECTROPHOTOGRAPHIC RED TONER

This application is a continuation of application Ser. No. 138,799, filed Dec. 29, 1987, now abandoned.

BACKGROUND OF THE INVENTION

The present invention relates to a red color toner that is capable of high-chroma reproduction of red-color images produced with a variety of writing instruments and materials.

Color recording in electrophotography can be accomplished by the following two methods: full-color copying which is designed to reproduce the colors of an original by the combination of toners having the three primary colors for substractive mixing, that is, magenta, yellow and cyan; and monochromatic (flat-color) copying which employs a black color and at least one non-black color to record part or all of the original in separate colors.

Originals may be multi-colored and can only be reproduced by full-color copying; among such originals are color photos, painted pictures, and full-color drawings. The other type of originals employs a black color and one or more other colors and included within this category of originals are black-colored originals, containing seal impressions, stamp marks, sentences, illustrations, corrections and underlines. The second type of originals is more frequently used and those containing red colors find the most frequent use. The red-color images produced in such originals have different shades depending upon the writing instruments and material used, as shown in FIGS. 3 and 4, in which (1) refers to a vermillion inkpad for impressing a seal, (2) and (7) a marking pen, (3), (4), (5), (11) and (13) a ball-point pen, (8) a stamp, (9) an oily ink felt pen, (10) a chart drawing ink, (6), (12), (15) and (16) a felt pen, and (14) a water-based ink.

However, red images on originals having such a broad spectrum of shades cannot be satisfactorily reproduced with the full-color toners conventionally employed in full-color copying. For instance, high-chroma red colors cannot be reproduced even if the magenta toner described in Unexamined Published Japanese Patent Application No. 27228/1974 is used in combination with the yellow toner described in Unexamined Published Japanese patent Application No. 17023/1977.

No red color toners have been known, either, that are successfully used in flat-color copying.

SUMMARY OF THE INVENTION

An object, therefore, of the present invention is to provide an electrophotographic red color toner that is capable of high-chroma reproduction of red color image produced with seals, as well as with conventional writing instruments and materials.

As a result of concerned efforts made to attain this object, the present inventors found that it could be effectively achieved by a red color toner having the composition described below. The present invention has been accomplished on the basis of this finding.

The electrophotographic red color toner of the present invention mainly comprises a binder resin and a colorant component, the colorant component being comprised of (1) a red pigment designated as C.I. Pigment Red 48:1, or (2) the combination of such C.I. Pigment Red 48:1, and a second red pigment selected from the group consisting of C.I. Pigment Red 122 and C.I. Pigment Red 57:1, the two red pigments being contained at a mixing weight ratio of 1:0 to 1:1, or (3) the combination of such C.I. Pigment Red 48:1 and a yellow pigment selected from the group consisting of C.I. Pigment Yellow 97 and C.I. Pigment Yellow 12, the red pigment and the yellow pigment being contained at a mixing weight ratio of 1:0 to 1:0.1.

DETAILED DESCRIPTION OF THE INVENTION

The pigments to be used in the present invention are commercially available and have the following chemical structures:

C.I. Pigment Red 48:1

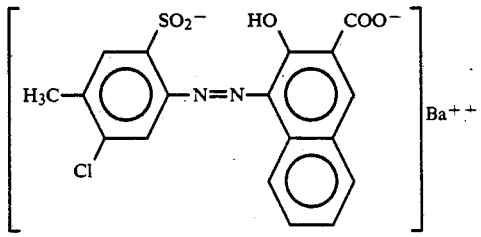

C.I. Pigment Red 122

-continued

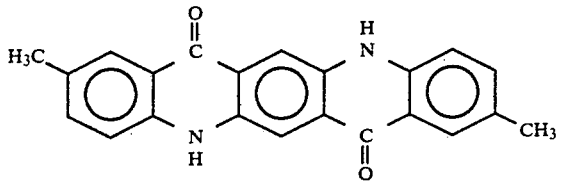

C.I. Pigment Red 57:1

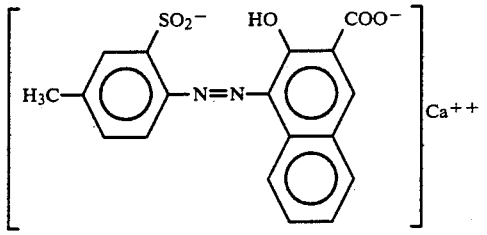

C.I. Pigment Yellow 97

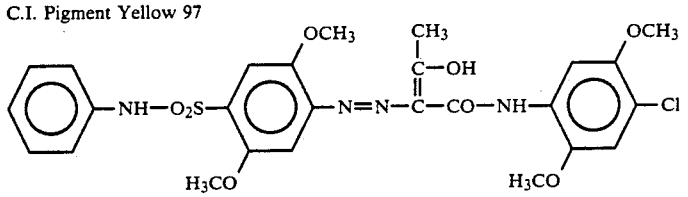

C.I. Pigment Yellow 12

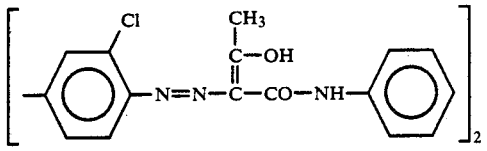

C.I. Pigment Red 48:1 used as the essential pigment in the present invention presents a beautiful red color of high chroma and may be used independently. However, in order to produce red colors with hues that are shifted toward the blue region as in (7) to (16) on FIG. 3, this pigment is preferably used in combination with at least one pigment selected from the group consisting of C.I. Pigment Red 122 and C.I. Pigment Red 57:1. Combined use of these pigments is effective in shifting the hue of a red color toward the blue region without causing any substantial decrease in its chroma. In the case of using the two red pigments in combination, C.I. Pigment Red 48:1 is mixed with C.I. Pigment Red 122 and/or C.I. Pigment Red 57:1 at a weight ratio of 1:0 to 1.1.

Figure 3:
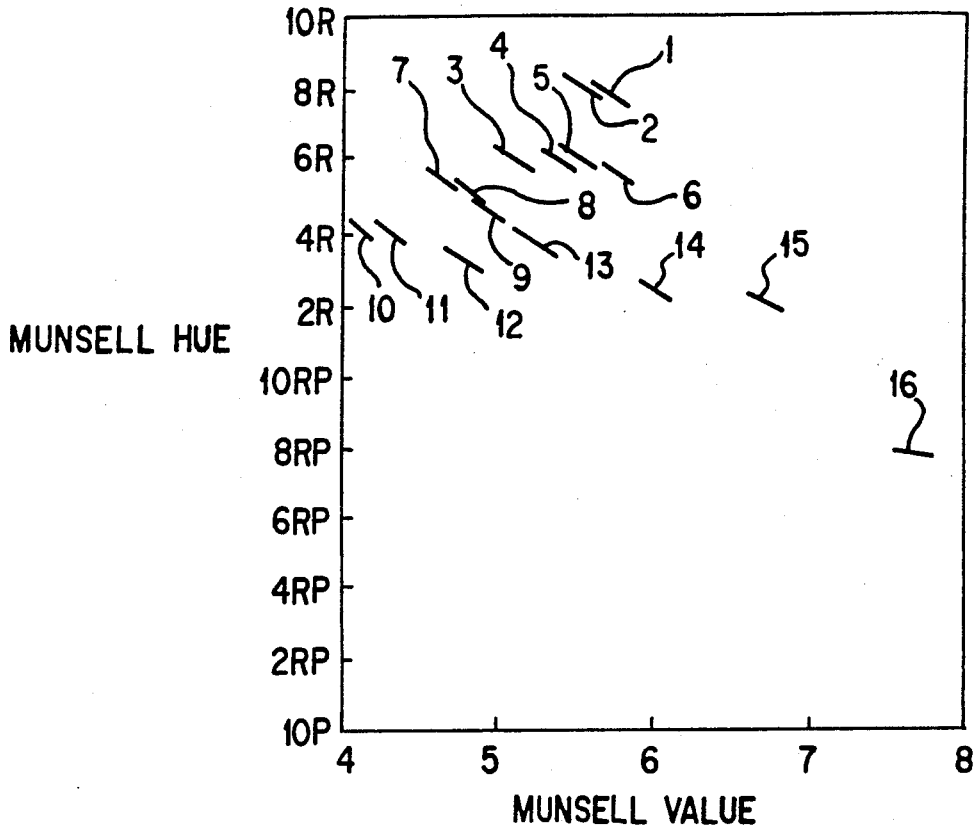
FIG. 3 is a graph showing the relationship between the Munsell value and Munsell products of a vermillion inkpad recorded with commercial products of a vermillion inkpad and writing instruments and materials.

For the purpose of reproducing the color of a vermillion inkpad indicated by (1) in FIG. 3 or a high-chroma vermillion color such as that of (2) noted in Table 3, it is preferred that C.I. Pigment Red 48:1 is used in combination with at least one yellow pigment selected from the group consisting of C.I. Pigment Yellow 97 and C.I. Pigment Yellow 12. Combined use of these pigments is effective in reproducing a vermillion color without substantially reducing its chroma. In the case of using C.I. Pigment Red 48:1 in combination with C.I. Pigment Yellow 97 and/or C.I. Pigment Yellow 12, the former is mixed with the latter at a weight ratio of 1:0 to 1:0.1.

In the present invention, the pigment component is preferably incorporated in such an amount that its total weight is in the range of 1 to 20%, more preferably 3 to 10%, of the weight of the binder resin in the red color toner. If the total amount of the pigments employed is less than about 1% of the weight of the binder resin, the color density of the resulting toner layer will be decreased and the need to use an unduly great amount of the toner for attaining a given image density will cause poor image fixing. If the total amount of the pigments exceeds about 20% of the weight of the binder resin, it becomes difficult to control image gradation and, not only the chargeability of toner particles, but also the fixability of toner image will shift to unfavorable conditions, causing premature deterioration of the developer.

Various binder resins may be employed in the red color toner of the present invention and they include homo- and copolymers of the following monomers: styrenes such as styrene, chlorostyrene and vinylstyrene; monoolefins such as ethylene, propylene, butylene and isoprene; vinyl esters such as vinyl acetate, vinyl propionate, vinyl benzoate and vinyl acetate; esters of α-methylene aliphatic monocarboxylic acids such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ehters such as vinyl methyl ether, vinyl ethyl ether and vinyl butyl ether; and vinyl ketones such as vinyl methyl ketone, vinyl hexyl ketone and vinyl isopropenyl ketone. Most typical of these binder resins includes polystyrene; styrene/alkyl acrylate copolymers, styrene/alkyl methacrylate copolymers, styrene/acrylonitrile copolymers, styrene/butadiene copolymers, styrene/maleic anhydride copolymers, polyethylene and polypropylene.

Also usable as binder resins are polyesters, polyurethanes, epoxy resins, silicone resins, polyamides, modified rosins, paraffins and waxes.

The binder resins that can be used in the present invention are not necessarily limited to those listed above, any resin having the desired properties may be used.

The toner of the present invention comprises particles having an average size of less than about 30 μm, preferably in the range of 3 to 20 μm.

As required, a charge controlling agent or a cleaning aid may be incorporated in or used with the toner of the present invention. Suitable charge controlling agents and cleaning aids are the powders of colloidal silica, poly(vinylidene fluoride), poly(methyl methacrylate), a mixture of tin oxides, a mixture of aluminum oxides, and a mixture of titanium oxides. The additives that can be employed in the present invention are not limited to those listed above.

The electrophotographic red color toner of the present invention having the composition described above has such hue and chroma characteristics that a toner image fixed on a sheet of white paper has a Munsell hue of 10 RP to 8 R and a Munsell chroma of 13 to 16 at a Munsell value of 5.5.

The following examples are provided for the purpose of further illustrating the present invention but are not to be taken as limiting the scope of the present invention.

EXAMPLE 1

Toner samples were prepared for mixtures of C.I. Pigment Red 48:1 (Sumikaprint Red KF of Sumitomo Chemical Co., Ltd.), C.I. Pigment Red 122 (Fastogen Super Magenta RE-01 of Dainippon Ink & Chemicals, Inc.) and C.I. Pigment Yellow 97 (Symuler Fast Yellow 4186 of Dainippon Ink & Chemicals with the proportions being varied as indicated in the following table, wherein the proportions of binder resin and indicated pigments are given in parts by weight.

TABLE

| Sample No. | Binder resin*1 | Pigment Red 48:1*2 | Pigment Red 122*3 | Pigment Yellow 97*4 | Mixing Ratio |
|---|---|---|---|---|---|
| 1 | 100 | 5.0 | 0 | 0 | 1:0 |
| 2 | 100 | 4.85 | 0.15 | 0 | 1:0.03 |
| 3 | 100 | 4.69 | 0.31 | 0 | 1:0.067 |
| 4 | 100 | 4.59 | 0.41 | 0 | 1:0.09 |
| 5 | 100 | 4.28 | 0.72 | 0 | 1:0.17 |
| 6 | 100 | 3.76 | 1.24 | 0 | 1:0.33 |
| 7 | 100 | 3.53 | 1.67 | 0 | 1:0.5 |
| 8 | 100 | 2.5 | 2.5 | 0 | 1:1 |
| 9 | 100 | 0 | 5.0 | 0 | 0:1 |
| 10 | 100 | 4.55 | 0 | 0.45 | 1:0.1 |

*1Binder resin: styrene/n-butyl methacrylate copolymer
*2Sumikaprint Red KF (Sumitomo Chemical Co., Ltd.)
*3Fastogen Super Magenta RE-01 (Dainippon Ink & Chemicals, Inc.)
*4Symuler Fast Yellow 4186 (Dainippon Ink & Chemicals, Inc.)

The formulations shown in the table were mixed in a molten state, ground into fine particles and classified to make red toners having an average particle size of 11.0 μm.

Fifty grams of each of these toners were mixed with 1 kg of a steel shot carrier composed of particles having an average size of 100 μm. The resulting developers were set on a copying machine (Model 3870 of Fuji Xerox Co., Ltd.) and a red image was formed with each developer. Using a spectrophotometer (a Color Pack System of Shimadzu Corporation), three tristimulus values, X, Y and Z, of the CIE 1931 standard colorimetric system were determined for each image, transformed to the corresponding hue, value and chroma on the Munsell color-order system, and plotted. The results are shown in FIGS. 1 and 2.

Figure 1:
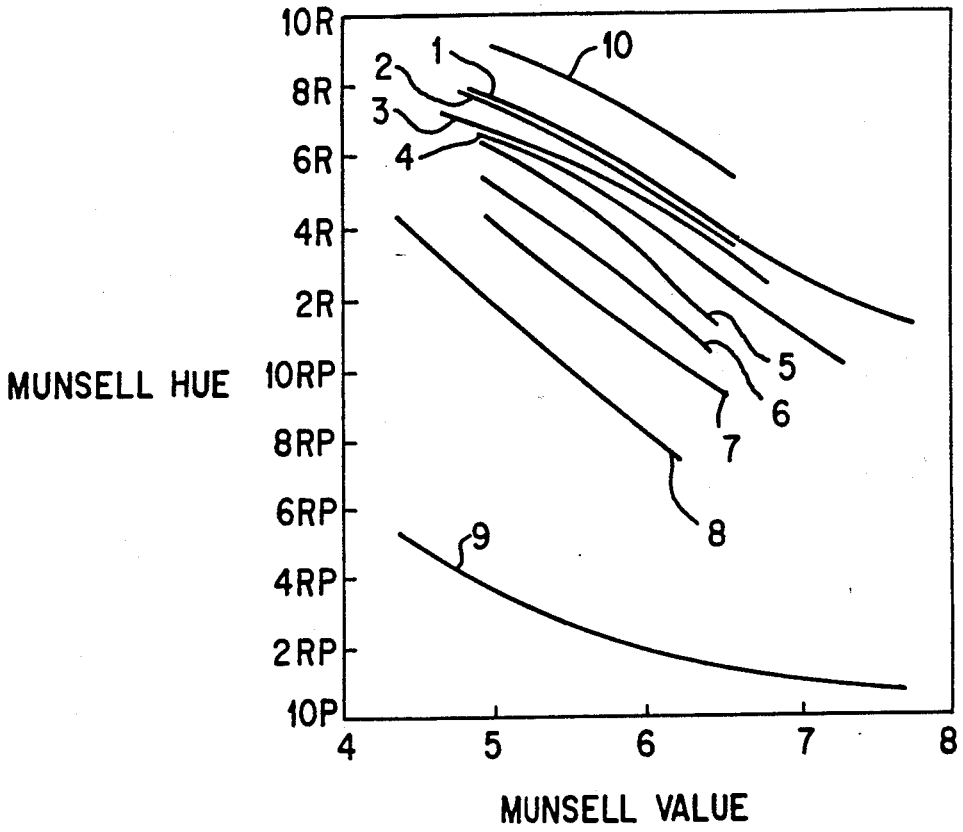
FIG. 1 is a graph showing the relationship between the Munsell value and Munsell hue of red images produced with the toners prepared in Example 1.
Figure 2:
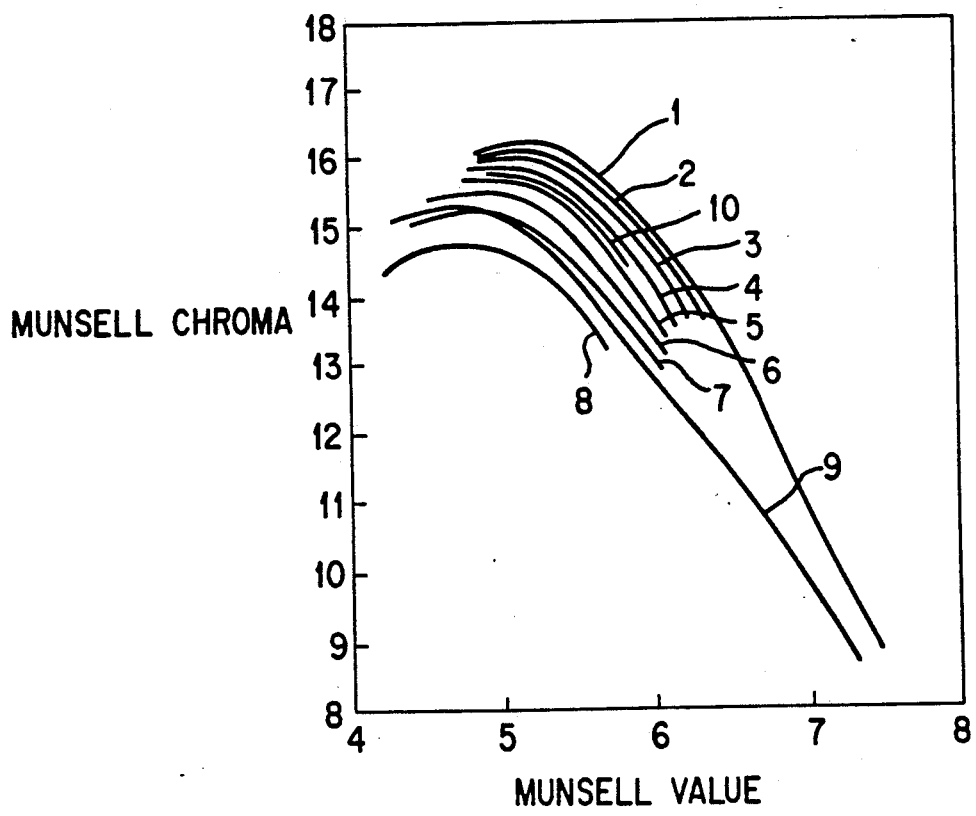
FIG. 2 is a graph showing the relationship between the Munsell value and Munsell chroma of red images produced with the toners of Example 1.

FIG. 1 shows the relationship between Munsell value and Munsell hue, and FIG. 2 shows the relationship between Munsell value and Munsell chroma.

Figure 4:
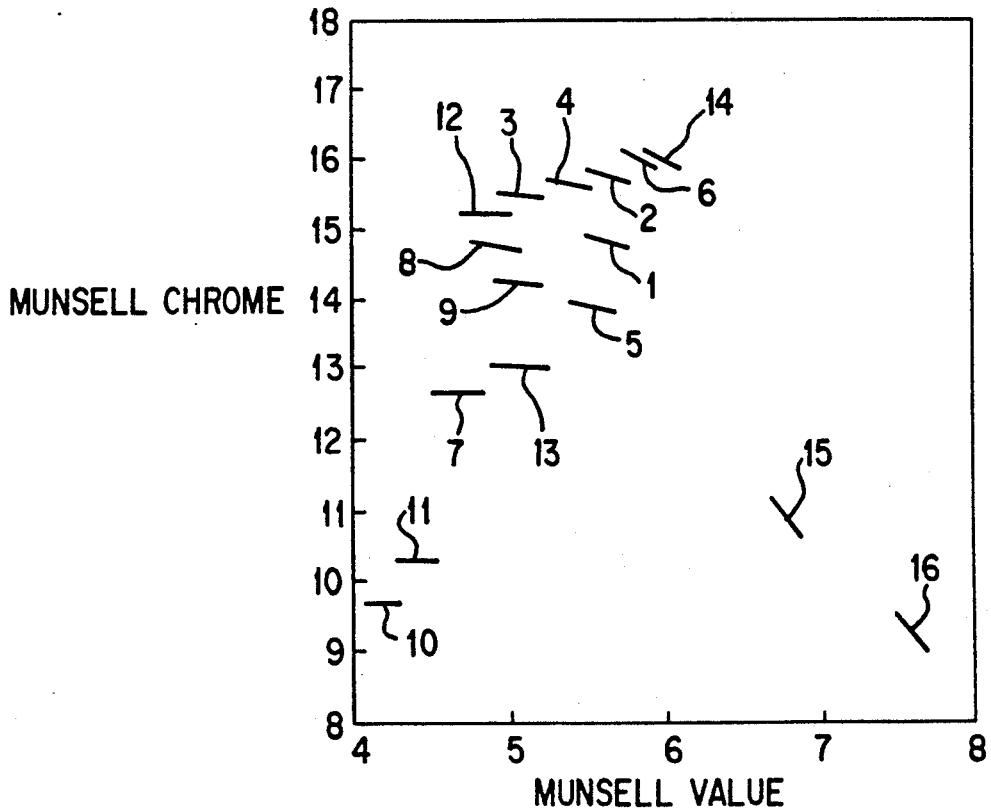
FIG. 4 is a graph sowing the relationship between the Munsell value and Munsell chroma of red images produced with the above commercial products.

From FIGS. 1 and 2, one can see that sample Nos. 1-10, except for sample No. 9, are capable of satisfactorily reproducing the shades of the red images shown in FIGS. 3 and 4 that were recorded with a vermillion inkpad and various writing instruments and materials.

EXAMPLE 2

A hundred parts by weight of the toner of sample No. 10 was mixed in a Henschel mixer with 0.5 parts by weight of the powder of poly(vinylidene fluororide) and 0.5 parts by weight of colloidal silica, so as to make a toner.

Fifty grams of this toner was mixed with 1 kg of a carrier composed of ferrite cores having an average size of 130 μm that were coated with a styrene/n-butyl methacrylate copolymer, so as to make a developer. The developer was subjected to a continuous copying test for producing $1.5\times10^4$ prints on a copying machine (Model 3870 of Fuji Xerox Co., Ltd.). Images of consistent quality were successfully produced without causing any significant drop in the quantity of electrical charges.

All of the images produced had such a shade that they faithfully reproduced the color of a vermillion inkpad for impressing a seal [(1) in FIG. 3]. Their scales on the Munsell color system were as follows: 8R, 5.5 V/15.5.

EXAMPLE 3

| | |
|---|---|
| Graft polymer of polypropylene and styrene/n-butyl methacrylate copolymer | 54 parts by weight |
| Styrene/n-butyl methacrylate crosslinked polymer | 36 parts by weight |
| C.I. Pigment Red 48:1 (Symuler Neothol Red 2BY of Dainippon Ink & Chemicals, Inc.) | 10 parts by weight |

These components were mixed in a molten state, ground into fine particles, and classified to make red particles having an average size of 12 μm.

A hundred parts by weight of these red particles were mixed in a Henschel mixer with 0.5 parts by weight of poly(methyl methacrylate) powder, 0.5 parts by weight of colloidal silica and 1.0 parts by weight of a powdered mixture of tin oxides, so as to make a toner.

This toner was processed as in Example 2 to make a developer, which was subjected to a continuous copying test for producing $1.5\times10^4$ prints on a copying machine (Model 4770 of Fuji Xerox Co., Ltd.). Images of consistent quality were successfully produced without causing any substantial drop in the quality of electrical charges.

All of the images produced had such a shade that they faithfully reproduced the brilliant red color produced by a ball-point pen [(4) and (5) in FIG. 3]. They had the following scales on the Munsell color system: 6.5 R, 5.5 V/16.

EXAMPLE 4

| | |
|---|---|
| Polyester having their terminals | 34 parts by weight |

-continued

| | |
|---|---|
| esterified with dimethyl | |
| Polypropylene wax | 1 part by weight |
| Styrene/n-butyl methacrylate copolymer | 55 parts by weight |
| C.I. Pigment Red 48:1 (Sumikaprint Red KF of Sumitomo Chemical Co., Ltd.) | 5 parts by weight |
| C.I. Pigment Red 122 (Fastogen Super Magenta RE-01 of Dainippon Ink & Chemicals, Inc.) | 5 parts by weight |

These components were mixed in a molten state, ground in to fine particles and classified to make red particles having an average size of 11.5 μm.

A hundred parts by weight of these red particles were mixed in a Henschel mixer with 2.0 parts by weight of a powdered mixture of titanium oxides, so as to made a toner.

The following components were mixed in a molten state, ground into fine particles and classified to make a carrier having an average particle size of 35 μm.

| | |
|---|---|
| Styrene/butyl methacrylate copolymer | 30 parts by weight |
| Magnetite powder | 70 parts by weight |

A hundred parts by weight of this carrier was mixed with 10 parts by weight of the previously prepared toner to make a developer.

This developer was set on a copying machine (Model 7790 of Fuji Xerox Co., Ltd.) and subjected to a continuous copying test for producing $1\times10^5$ prints. Images of consistent quality were successfully produced.

All of the images produced had such a shade that they faithfully reproduced the bluish brilliant red color produced by a felt pen [(12) in FIG. 3]. They had the following scales on the Munsell color system: 10 RP, 5.5 V/13.8.

EXAMPLE 5

A toner and a developer were prepared as in Example 3 except that 10 parts by weight of C.I. Pigment Red 48:1 in the toner formulation was replaced by the following:

| | |
|---|---|
| C.I. Pigment Red 48:1 (Symuler Neothol Red 2BY of Dainippon Ink & Chemicals, Inc.) | 5 parts by weight |
| C I. Pigment Red 57:1 (ZAB-083 RED of Dainichiseika Colour & Chemicals Mfg. Co., Ltd.) | 5 parts by weight |

The developer was set on a copying machine (Model 3870 of Fuji Xerox Co., Ltd.) and subjected to a continuous copying test for producing $1.5\times10^4$ prints. Images of consistent quality were successfully produced.

All of the images produced such a shade that they faithfully reproduced the bluish brilliant red color produced by a felt pen [(12) in FIG. 3]. They had the following scales on the Munsell color system: 10 RP, 5.5 V/13.5.

EXAMPLE 6

A toner and a developer were prepared as in Example 3 except that 10 parts by weight of C.I. Pigment Red 48:1 in the toner formulation was replaced by the following:

| | |
|---|---|
| C.I. Pigment Red 48:1 (Symuler Neothol Red 2BY of Dainippon Ink & Chemicals, Inc.) | 9.1 parts by weight |
| C.I. Pigment Yellow 12 (Sumikaprint Yellow ST:O:M of Sumitomo Chemical Co., Ltd.) | 0.9 part by weight |

The developer was set on a copying machine (Model 3870 of Fuji Xerox Co., Ltd.) and subjected to a continuous copying test for producing $1.5\times10^4$ prints. Images of consistent quality were successfully produced.

All of the images produced had such a shade that they faithfully reproduced the color of a vermillion inkpad for impressing a seal [(1) in FIG. 3]. They had the following scales on the Munsell color system 8 R, 5.5 V/15.5.

EXAMPLE 7

A toner and a developer were prepared as in Example 3 except that 10 parts by weight of C.I. Pigment Red 48:1 in the toner formulation was replaced by the following:

| | |
|---|---|
| C.I. Pigment Red 48:1 (Sumikaprint Red KF of Sumitomo Chemical Co., Ltd.) | 7.5 parts by weight |
| C.I. Pigment Red 122 (Fastogen Super Magenta RE-01 of Dainippon Ink & Chemicals, Inc.) | 2.5 parts by weight |

The developer was set on a copying machine (Model 3870 of Fuji Xerox Co., Ltd.) and subjected to a continuous copying test for producing $1.5\times10^4$ prints. Images of consistent quality were successfully produced.

All of the images produced had such a shade that they faithfully reproduced the brilliant red color of a stamping ink [(8) in FIG. 3] and the hue of the color produced by a marking pen [(7) in FIG. 3]. They had the following scales on the Munsell color system: 3.5 R, 5.5 V/14.8.

COMPARATIVE EXAMPLE 1

A toner and a developer were prepared as in Example 3 except that 10 parts by weight of C.I. Pigment Red 48:1 in the toner formulation was replaced by the following:

| | |
|---|---|
| C.I. Pigment Red 48:1 (Symuler Neothol Red 2BY of Dainippon Ink & Chemicals, Inc.) | 8.0 parts by weight |
| C.I. Pigment Yellow 97 (Symuler Fast Yellow 4186 of Dainippon Ink & Chemicals, Inc.) | 2.0 parts by weight |

The developer was set on a copying machine (Model 3870 of Fuji Xerox Co., Ltd.) and subjected to a copying test. The red color of the images it produced had such a strong yellow tinge that it was unsuitable for reproducing any of the red-colored images produced with writing instruments or materials. The images this developer produced had the following scales on the Munsell color system: 10 R, 5.5 V/14.

COMPARATIVE EXAMPLE 2

A toner and a developer were prepared as in Example 3 except that 10 parts by weight of C.I. Pigment Red 48:1 in the toner formulation was replaced by the following:

| | |
|---|---|
| C.I. Pigment Red 48:1 (Sumikaprint Red KF of Sumitomo Chemical Co., Ltd.) | 3.0 parts by weight |
| C.I. Pigment Red 122 (Fastogen Super Magenta RE-01 of Dainippon Ink & Chemicals, Inc.) | 7.0 parts by weight |

The developer was set on a copying machine (Model 3870 of Fuji Xerox Co., Ltd.) and subjected to a copying test. The red color of the images it produced had such a strong blue tinge that it was unsuitable for reproducing any of the red-colored images produced with writing instruments or materials. The images this developer produced had the following scales on the Munsell color system: 8 RP, 5.5 V/14.

COMPARATIVE EXAMPLE 3

A toner and a developer were prepared as in Example 3 except that 10 parts by weight of C.I. Pigment Red 48:1 in the toner formulation was replaced by the following:

| | |
|---|---|
| C.I. Pigment Yellow 97 (Symuler Fast Yellow 4186 of Dainippon Ink & Chemicals, Inc.) | 4.0 parts weight |
| C.I. Pigment Red 122 (Fastogen Super Magenta RE-01 of Dainippon Ink & Chemicals, Inc.) | 6.0 parts by weight |

The developer was set on a copying machine (Model 3870 of Fuji Xerox Co., Ltd.) and subjected to a copying test. The red images it produced had only low chroma. They had the following scales on the Munsell color system: 5 R, 5.5 V/12.

The electrophotographic red color toner of the present invention has such hue and chroma characteristics that it produces an image which, when fixed on a sheet of white paper, has a Munsell hue of 10 RP to 8 R and a Munsell chroma of 13 to 16 at a Munsell value of 5.5. Therefore, this toner provides for high-chroma reproduction of the red images recorded with a vermillion inkpad for impressing a seal or writing instruments such as ball-point pens, felt pens, marking pens and stamps. As a further advantage, the red image produced with this toner has consistent quality.

While the invention has been described in detail and with reference to specific embodiments thereof, it will be apparent to one skilled in the art that various changes and modifications can be made therein without departing from the spirit and scope thereof.

What is claimed is:

1. An electrophotographic red color toner which is mainly comprised of a binder resin and a colorant component, said colorant component being: a red pigment designated as C.I. Pigment Red 48:1; or the combination of said C.I. Pigment 48:1 and a second red pigment selected from the group consisting of C.I. Pigment Red 122 and C.I. Pigment Red 57:1, the two red pigments being contained at a mixing weight ratio of 1:0 to 1:1; or the combination of said C.I. Pigment Red 48:1 and a yellow pigment selected from the group consisting of C.I. Pigment Yellow 97 and C.I. Pigment Yellow 12, the red pigment and the yellow pigment being contained at a mixing weight ratio of 1:0 to 1:0.1.

2. An electrophotographic red color toner according to claim 1, wherein the total weight of the colorant component is in the range of about 1% to about 20% of the weight of the binder resin.

3. An electrophotographic red color toner according to claim 1, which produces an image which, when fixed on a sheet of white paper, has a Munsell hue of 10 RP to 8 R and a Munsell chroma of 13 to 16 at a Munsell value of 5.5.

4. An article of manufacture comprising a white paper having an electrophotographic image thereon, said image having a Munsell hue of 10 RP to 8 R and a Munsell chroma of 13 to 16 at a Munsell value of 5.5, said image having been formed by use of an electrophotographic red color toner comprised of a binder resin and a colorant component, said colorant component being: a red pigment designated as C.I. Pigment Red 48:1, or the combination of said C.I. Pigment 48:1 and a second red pigment selected from the group consisting of C.I. Pigment Red 122 and C.I. Pigment Red 57:1, the two red pigments being contained at a mixing weight ratio of 1:0 to 1:1; or the combination of said C.I. Pigment Red 48:1 and a yellow pigment selected from the group consisting of C.I. Pigment Yellow 97 and C.I. Pigment Yellow 12, the red pigment and the yellow pigment being contained at a mixing weight ratio of 1:0 to 1:0.1.

5. The article of claim 1, wherein the total weight of said colorant component in said toner is in the range of about 1 percent to about 20 percent of the weight of said binder resin.

* * * * *